US009523217B2

(12) United States Patent
Clifford

(10) Patent No.: US 9,523,217 B2
(45) Date of Patent: Dec. 20, 2016

(54) VARIABLE SECTION KEY AND LOCK

(71) Applicant: Schlage Lock Company LLC, Indianapolis, IN (US)

(72) Inventor: Jason C. Clifford, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 114 days.

(21) Appl. No.: 13/888,929

(22) Filed: May 7, 2013

(65) Prior Publication Data

US 2013/0298623 A1 Nov. 14, 2013

Related U.S. Application Data

(60) Provisional application No. 61/644,383, filed on May 8, 2012.

(51) Int. Cl.

| | |
|---|---|
| ***E05B 19/18*** | (2006.01) |
| ***E05B 19/00*** | (2006.01) |
| ***E05B 27/08*** | (2006.01) |
| ***E05B 27/00*** | (2006.01) |
| ***E05B 35/00*** | (2006.01) |

(52) U.S. Cl.

CPC ..... *E05B 19/0052* (2013.01); *E05B 19/00* (2013.01); *E05B 19/0017* (2013.01); *E05B 19/0023* (2013.01); *E05B 19/18* (2013.01); *E05B 27/00* (2013.01); *E05B 27/08* (2013.01); *E05B 35/003* (2013.01); *Y10T 70/7559* (2015.04); *Y10T 70/7565* (2015.04); *Y10T 70/7605* (2015.04); *Y10T 70/7842* (2015.04); *Y10T 70/7864* (2015.04)

(58) Field of Classification Search

CPC .. E05B 19/00; E05B 19/0017; E05B 19/0023; E05B 19/04; E05B 19/18

USPC ..... 70/350, 351, 393, 395, 398, 399, 402,70/405, 406, 409, 411, 490–493

See application file for complete search history.

(56) References Cited

U.S. PATENT DOCUMENTS

| | | | | |
|---|---|---|---|---|
| 742,815 A | | 10/1903 | Valerius | |
| 939,679 A | * | 11/1909 | Freud | E05B 19/18 70/411 |
| 1,438,336 A | | 12/1922 | Schroeder | |
| 3,243,979 A | * | 4/1966 | Silvern | 70/411 |
| 3,902,342 A | | 9/1975 | Zucker | |

(Continued)

FOREIGN PATENT DOCUMENTS

WO WO 00/57006 9/2000

OTHER PUBLICATIONS

International Search Report for PCT/US13/40218; Apr. 25, 2014; 2 pages.

(Continued)

*Primary Examiner* — Christopher Boswell
(74) *Attorney, Agent, or Firm* — Taft Stettinius & Hollister LLP

(57) ABSTRACT

A key and lock are provided. The key is provided with a blade having a longitudinal axis. The blade is provided with a channel extending along at least a portion of the blade and along the longitudinal axis. One or more section members is disposed within the channel and coupled to the blade. The section member is capable of movement relative to the blade in the channel. A lock having a keyway and an associated tortuous path to receive the section members as the blade is inserted in the keyway is also provided.

19 Claims, 2 Drawing Sheets

(56) References Cited

U.S. PATENT DOCUMENTS

| | | | | |
|---|---|---|---|---|
| 4,111,019 | A | 9/1978 | Rabinow | |
| 4,296,618 | A | 10/1981 | Guiraud | |
| 4,478,061 | A | 10/1984 | Preddey | |
| 4,498,327 | A | 2/1985 | Preddey | |
| 4,545,226 | A * | 10/1985 | Urrestarazu-Borda | E05B 19/18 70/398 |
| 4,603,565 | A | 8/1986 | Strassmeir | |
| 4,662,200 | A * | 5/1987 | Borda | 70/411 |
| 4,667,495 | A | 5/1987 | Girard | |
| 4,747,282 | A * | 5/1988 | Nyun | E05B 17/16 70/398 |
| 4,760,722 | A | 8/1988 | Fann | |
| 4,787,225 | A | 11/1988 | Hauser et al. | |
| 5,131,247 | A * | 7/1992 | Hsu | 70/358 |
| 5,170,651 | A * | 12/1992 | Errani | E05B 35/004 70/395 |
| 5,222,383 | A | 6/1993 | Fann et al. | |
| 5,349,830 | A | 9/1994 | Keller | |
| 5,671,623 | A * | 9/1997 | Hsu | 70/375 |
| 5,775,144 | A * | 7/1998 | Pagalday | E05B 35/004 70/358 |
| 5,839,308 | A * | 11/1998 | Eizen et al. | 70/358 |
| 6,378,345 | B1 * | 4/2002 | Lin | 70/409 |
| 6,481,255 | B2 | 11/2002 | Theriault | |
| 6,508,091 | B1 * | 1/2003 | Donatini | 70/359 |
| 6,584,819 | B1 | 7/2003 | Hung | |
| 6,681,609 | B1 | 1/2004 | Preddey | |
| 6,968,717 | B2 | 11/2005 | Suzuki | |
| 7,370,503 | B2 | 5/2008 | Keller | |
| 7,647,799 | B2 | 1/2010 | Markbreit et al. | |
| 8,387,425 | B2 * | 3/2013 | Ben-Aharon et al. | 70/405 |
| 2004/0000178 | A1 | 1/2004 | Tseng | |
| 2004/0148989 | A1 | 8/2004 | Hsieh | |
| 2006/0272372 | A1 * | 12/2006 | Talamonti | E05B 35/004 70/358 |
| 2009/0113965 | A1 * | 5/2009 | Weinberger | E05B 27/0021 70/493 |
| 2010/0212382 | A1 | 8/2010 | Martikainen | |
| 2011/0072867 | A1 * | 3/2011 | Haviv et al. | 70/357 |
| 2011/0146360 | A1 | 6/2011 | Ben-Aharon et al. | |
| 2011/0302972 | A1 | 12/2011 | Higuchi | |
| 2012/0055212 | A1 | 3/2012 | Nicoara | |
| 2012/0073340 | A1 | 3/2012 | Widen | |

OTHER PUBLICATIONS

Written Opinion of the International Searching Authority for PCT/US13/40218; Apr. 25, 2014; 6 pages.

International Search Report and Written Opinion, International Application No. PCT/US2013/039928; Sep. 6, 2013; 6 pages.

* cited by examiner

VARIABLE SECTION KEY AND LOCK

CROSS REFERENCE TO RELATED APPLICATIONS

The present application claims priority to and benefit under 35 U.S.C. §119(e) to U.S. Provisional App. No. 61/644,383, filed May 8, 2012, the entire contents of which are incorporated herein by reference.

TECHNICAL FIELD

The present disclosure generally relates to key and lock systems, and more particularly, but not exclusively, to keys having blades with movable members that define variable sections for the keys.

BACKGROUND

Alleviating difficulties associated with copying of keys and secure locks remains an area of interest. Present approaches to this suffer from a variety of limitations and disadvantages relative to certain applications. Accordingly, there is a need for further contributions to this technology.

SUMMARY

One embodiment of the present disclosure is a unique key having section members in the blade of the key that are movable in a direction between opposite sides of the key to form variable profiles that match the profile shape of the keyway in the lock cylinder associated with the key. Other embodiments include apparatuses, systems, devices, hardware, methods, and combinations for the same. Further embodiments, forms, features, aspects, benefits, and advantages of the present application shall become apparent from the description and figures provided herewith.

DETAILED DESCRIPTION

Figure 1:
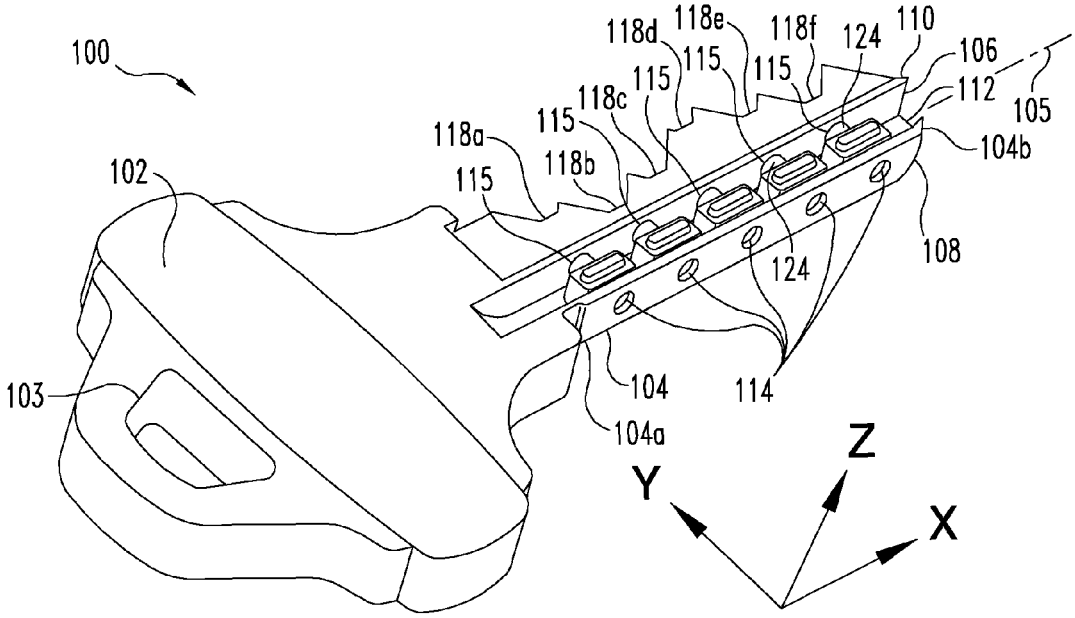
FIG. 1 depicts one embodiment of a key according to the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
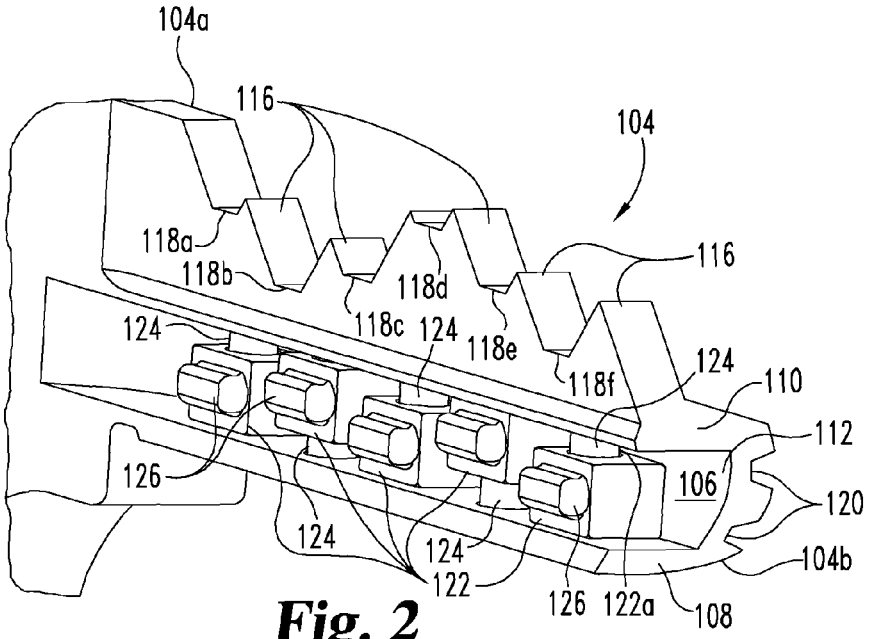
FIG. 2 illustrates the shank of the key embodiment portrayed in FIG. 1.

With reference to FIGS. 1 and 2, an example key 100 is provided with a handle, head portion, or bow 102 for handling the key 100, and a blade 104 extending therefrom. The bow 102 may be provided with an opening 103 for attaching the key 100 to a key chain (not shown), for example. The bow 102 may also generally be wider than the blade to ease the act of turning the key 100 when the key is inserted in a corresponding lock. The size of the bow 102 may be determined by the amount of torque required to turn the key 100, among other factors, and may also provide a surface for labeling the key 100 with useful information, such as a lock code, for example.

The blade 104 is generally provided with a proximal end 104*a* that is attached to the bow 102. The blade 104 may be integral as one piece with the bow 102 or may be mounted or secured thereto by other means. The blade 104 extends away from bow 102 to a distal end 104*b* that is opposite proximal end 104*a*. Blade 104 extends along a longitudinal axis 105 generally parallel to the x-axis from the proximal end 104*a* to the distal end 104*b*. In the illustrated embodiment, the bow 102 is depicted as being generally planar and lying in a plane generally coincident with the x-y plane, and in which the longitudinal axis 105 coincides.

The blade 104 is provided with an elongated channel 106 running along the length of the blade 104 and generally parallel to the longitudinal axis 105. The channel 106 is defined by a first side wall 108, a second side wall 110, and a base wall 112. The first side wall 108 is generally planar and lies in a plane substantially orthogonal to the plane in which the bow 102 lies, such as the x-z plane. Second side wall 110 is disposed on the opposite side of the channel 106 in facing relation to the first side wall 108. The first side wall 108 and the second side wall 110 are generally parallel to one another. Base wall 112 connects the two side walls 108, 110 and is generally perpendicular thereto. Thus, the channel 106 is defined by the three walls 108, 110, 112 such that it has an open side extending along the length of blade 104. The channel 106 may also be provided with an open end at the distal end 104*b* of the blade 104, and a sloped transition to the adjacent outer surface of bow 102.

The second side wall 110 is provided, opposite the channel 106, with an exterior surface including teeth 116 that are defined by bitting positions 118*a*, 118*b*, 118*c*, 118*d*, 118*e*, 118*f*. Teeth 116 can be of the type typically found on traditional keys used to unlock a traditional pin tumbler lock. It is appreciated however, that the embodiments of the present disclosure may be utilized in locks other than the pin tumbler variety. In one embodiment, second side wall 110 is smooth like the outer surface of first side wall 108. The base wall 112 is provided with an exterior surface, opposite the channel 106, having one or more grooves 120 therein that extend substantially parallel to the longitudinal axis.

While the present key 100 is described as shown herein, it is appreciated that other configurations regarding the bow 102 and blade 104 geometry are possible. For example, the blade 102 may not be planar and/or may lie in a plane that does not coincide with the longitudinal axis. Further, the channel 106 and its associated walls 108, 110, 112 may be arranged differently and may have the various described features on walls different than that described herein.

In the shown embodiment, the first side wall 108 is depicted as substantially planar and is provided with a plurality of through-holes 114 in communication with the channel 106 and the exterior surface of the first side wall 108. Second side wall 110 includes a plurality of bores 115 aligned with respective ones of the through-holes 114. A plurality of support members 124 in channel 106 extend between and are secured to blade 104 in respective ones of the aligned through-holes 114 and bores 115.

A plurality of section members 122 are disposed within the channel 106 and secured to blade 104 with respective ones of a plurality of support members 124. Each section member 122 includes a through-hole 122*a* that accepts the respective support member 124 therethrough. The support members 124 may be installed after the section members 122 are placed within the channel 106. The support members 124 can be driven through the respective through-holes 114 in the first side wall 108, through the through-hole 122*a* in the respective section member 122, and into the aligned bore 115 in the second side wall 110.

The diameter of the through-holes 114 in the first sidewall 108 and through-hole 122*a* of the section members 122 are slightly larger than the outer dimension of the support members 124. It is appreciated that other designs are contemplated, such as by fixing the support members to the first side wall 108 or to the section members 122. The section members 122 are moveable along the support members 124 such that they may translate in a direction generally parallel to the y-axis, or in a direction between side walls 108, 110, with each section member 122 translating along the axis of its respective support member 124.

In certain embodiments, one or all of the support members 124 are engaged to only of the side walls 108, 110. In still other embodiments, support members 124 do not extend completely through their respective section member 122. In yet another embodiment, at least one support member 124 extends from side wall 108 and at least one other support member 124 extends from side wall 110, and each support member 124 supports the same section member 122. In one form, the support members 124 are aligned and allow the section member 122 to rotate about an axis extending between the support members 124. In another form, the support members 124 extending from the respective side walls 108, 100 are offset from one another. In still other embodiments, support members 124 are in the form of a cylindrical post. However, other shapes and configurations for support members 124 are contemplated.

A protrusion 126 may extend from each section member 122 toward the open side of the channel 106. The protrusions 126 may have the same or varying cross-sections, they may have the same varying lengths extending in a direction along the z-axis, and they may or may not extend beyond the confines of the blade 104 and/or channel 106. In one embodiment, protrusions 126 have a predetermined shape that allows the protrusions to be accepted or identified by the lock cylinder in which blade 104 is positioned. In other embodiments, one or more of section members 122 includes multiple protrusions.

The section members 122 may each be provided with a flat side opposite protrusion 126 that is generally parallel and adjacent to the base wall 112 so that base wall 112 restricts the section members 122 from rotating about their respective support member 124. Alternative embodiments may prevent section member rotation by providing the section members 122 with multiple support members 124 for each section member 122, or may provide a tongue and groove relationship between the section members 122 and the base wall 112. Furthermore, support members 124 prevent the respective section member 122 from moving along longitudinal axis 105 and confine the movement of section members 122 in a direction extending between side walls 108, 110.

The shown embodiment is provided with channel 106 having only a single open side. However, it is appreciated that the base wall 112, or portions thereof, may be removed to allow additional protrusions (not shown) to extend from the other side of the section members 122 toward the base wall 112. These additional protrusions (not shown) may be in addition to or instead of the protrusions 126 shown extending toward the open side of the channel 106.

Figure 3:
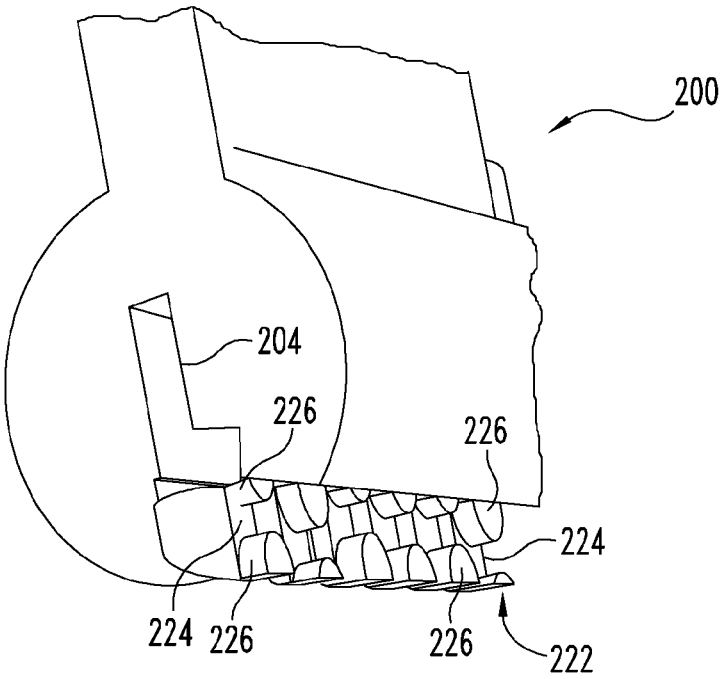
FIG. 3 shows an example cylinder usable with key of FIG. 1.

Referring now to FIG. 3 and with continued reference to FIGS. 1 and 2, an example lock cylinder 200 is provided as would be used in a lock associated with the key 100. The cylinder 200 is provided with a keyway 204 for receipt of key blade 104. Cylinder 200 includes a plurality of lock section members 222 that are fixedly mounted in the passage defined by keyway 204. The lock section members 222 define a tortuous passage along which key protrusions 126 are moved as key 100 is advanced into keyway 204. Within each member 222, a gap 224 is provided and defined by adjacent protrusions 226. The protrusions 226 may be provided with entry features, such as, for example, filleted or chamfered edges.

As a key blade 104 is inserted inside the keyway 204, the protrusions 126 of section members 122 translate or slide up and down their respective support member 124 in order to pass through the tortuous passage created by the gaps 224 in the lock section members 222. This is a warding feature that does not allow an incorrect key to fit within the keyway 204. Should any picking device be inserted within the keyway 204, it would likely be too thin to apply the appropriate amount of torque to turn the tumblers of the lock.

Instead of linear movement of the key section members 122 relative to the lock section members 222, some embodiments may employ rotational movement in which section members 122 rotate about an axis defined by the support members providing support thereto. Such examples may include using a rotatable screw device on the key and a corresponding opening within the keyway 204. Another example may operate with a pinion-like gear on the key and a corresponding rack within the keyway 204.

Figure 4:
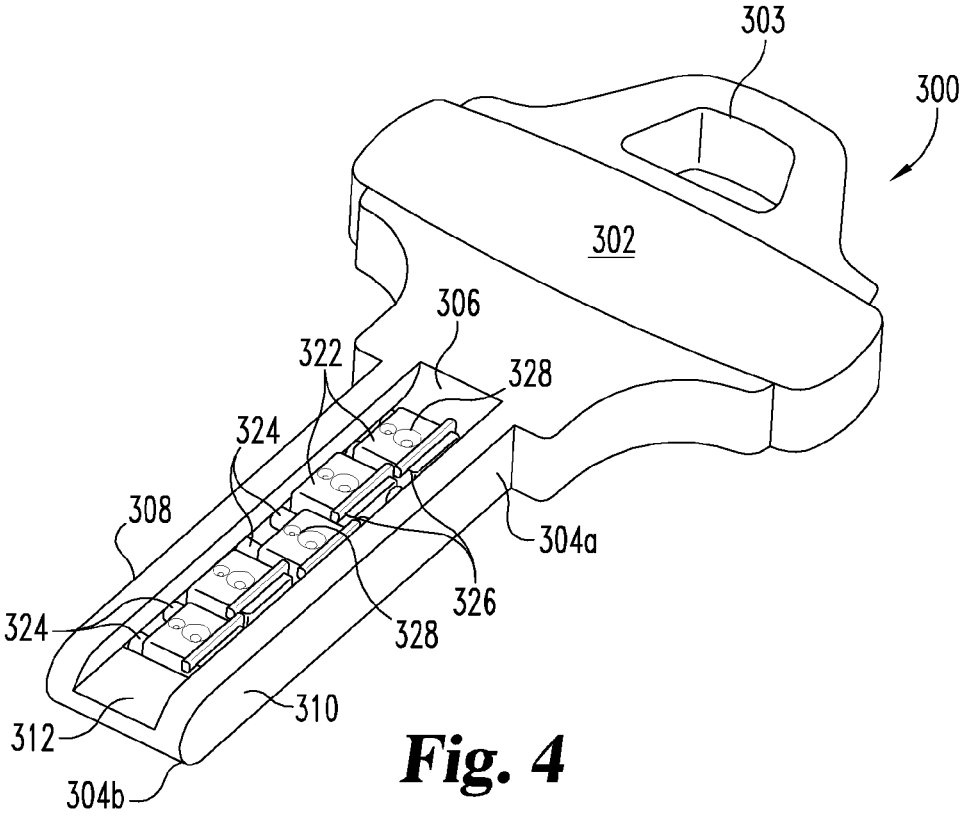
FIG. 4 depicts another embodiment of a key according to the present disclosure.

With reference to FIG. 4, an example embodiment of a key 300 is provided in a format that is typical of flat European-styled keys 300. The key 100 is provided with a handle, head portion, or bow 302 for handling the key 300, and a blade 304 extending therefrom. The bow 302 may be provided with an opening 303 for attaching the key 300 to a key chain (not shown), for example. The bow 302 may also generally be wider than the blade to ease the act of turning the key 300 when the key is inserted in a corresponding lock (not shown). The size of the bow 302 may be determined by the amount of torque required to turn the key 300, among other factors, and may also provide a surface for labeling the key 300 with useful information, such as a lock code, for example.

The blade 304 is generally provided with a proximal end 304*a* that is attached to the bow 302. The blade 304 may be integral with the bow 302 or may be attached or mounted thereto by other means. The blade 304 is also provided with a distal end 304*b* opposite proximal end 304*a*. A longitudinal axis extends along the blade 304 from the proximal end 304*a* to the distal end 304*b*.

The blade 304 is provided with a channel 306 running along the length of the blade 304 and generally parallel to the longitudinal axis. The channel 306 is defined by a first side wall 308, a second side wall 310, and a base wall 312. In the illustrated embodiment, the blade 304 is depicted as being generally planar and lying in a plane generally coincident with the longitudinal axis. The first side wall 308 is generally planar and lies in a plane substantially orthogonal to the plane in which the bow 302 lies. A second side wall 310 is disposed on the opposite side of the channel 306 from the first side wall 308. The first side wall 308 and the second side wall 310 are generally parallel to one another. A base wall 312 connects the two side walls 308, 310 and is generally perpendicular thereto. Thus, the channel 306 is defined by the three walls 308, 310, 312 such that it has an open side. The channel 306 may also be provided with an open end at the distal end 304*b* of the blade 304.

The first side wall 308 is substantially planar and is provided with a plurality of through holes (not shown) in communication with the channel 306 and the exterior surface of the first side wall 308. The second side wall 310 is provided, opposite the channel 306, with an exterior substantially planar surface. The base wall 312 is provided, opposite the channel 306, with an exterior substantially planar surface.

One or more section members 322 are disposed within the channel 306 and are each provided with a pair of through-holes for accepting respective ones of a pair of support members 324 for each section member 322. The support members 324 are also disposed within the channel 306 between side walls 308, 310. The support members 324 may be, for example, fixed to one or both of the side walls 308, 310 such as by a friction fit. The support members 324 may be installed after the section members 322 are placed within the channel 306. The diameter of the through-holes in the section members 322 are slightly larger than the diameter of the support members 324 to allow section members 322 to translate along support members 324. Unlike the key 100 depicted in FIGS. 1 and 2, the key 300 of FIG. 4 provides two support members 324 per section member 322. This prevents the section members 322 from rotating.

An identifiably-shaped protrusion 326 may extend from each section member 322 toward the open side of the channel 306. The protrusions 326 may have the same or varying cross-sections, they may have the same varying lengths extending in a direction along the longitudinal axis of blade 304, and they may or may not extend beyond the confines of the blade 304 and/or channel 306. In addition, the section members 322 may be provided with one or more depressions or dimples 328 that interact with pins in a corresponding lock. These depressions 328 may be of varying depth, size, and shape, and may vary from section member 322 to section member 322.

The shown embodiment is provided with a channel 306 having only a single open side. However, it is appreciated that the base wall 312, or portions thereof, may be removed to allow additional depressions (not shown) and/or protrusions (not shown) to extend from the other side of the section members 322 toward the base wall 312. These additional depressions (not shown) and/or protrusions (not shown) may be in addition to or instead of the depressions 328 and protrusions 326 shown on the open side of the channel 306.

One aspect of the present application provides a key having a bow and a blade attached to and extending away from the bow along a longitudinal axis. The blade has a channel extending along at least a portion of the blade and along the longitudinal axis. A plurality of section members are disposed within the channel and coupled to the blade, and capable of movement relative to the blade in the channel.

A refinement of the present disclosure provides that the section member has a protrusion extending toward an open side of the channel. Another refinement of the present disclosure provides that the section member has a depression facing the open side of the channel.

Yet another refinement provides that the section member is moveable along an axis that is perpendicular to the longitudinal axis. Another refinement provides that the channel is defined by at least one side wall having teeth opposite the channel. Yet another refinement provides that the section members are each moveable along a respective support member.

Another aspect of the present disclosure provides a lock cylinder with a keyway having multiple stationary section members. Each of the multiple stationary section members has opposite protrusions defining a gap therebetween. Together, the gaps in the multiple stationary section members form a tortuous path along the keyway.

A refinement of the present disclosure provides that the protrusions have entry features that facilitate passage of the key having the movable section members with protrusion into the gaps defined by the protrusion of the stationary section members. Another refinement of the present disclosure provides that the tortuous path is non-linear. Yet another refinement provides that the lock is a pin tumbler lock.

Yet another aspect of the present disclosure provides a system having a key with a bow and a blade attached to and extending away from the bow along a longitudinal axis. The blade has a channel extending along at least a portion of the blade. A plurality of section members are disposed within the channel and coupled to the blade and capable of movement relative to the blade. The system is further provided with a lock having a lock cylinder with a keyway comprising multiple stationary section members, the multiple stationary section members defining a tortuous path along the keyway. When the key is inserted into the keyway, the section members translates within the channel to pass through the tortuous path.

A refinement of the present disclosure provides that the lock is a pin tumbler lock. Another refinement of the present disclosure provides that the blade has teeth extending from a channel side wall opposite the channel. Yet another refinement of the present disclosure provides that the section members each have a key protrusion.

Another refinement provides that each of the multiple stationary section members have opposite lock protrusions defining a gap therebetween. Another refinement provides that each of the gaps is adjacent the keyway.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A key, comprising:

a bow;

a blade attached to and extending longitudinally away from said bow, wherein said blade defines a longitudinal axis and includes:

a longitudinally extending channel, wherein said channel has an open face and is defined by a first side wall, a second side wall opposite the first side wall, and a base wall opposite said open face, wherein said first and second side walls extend laterally from said open face to said base wall, and wherein said first and second side walls are transversely offset from one another and are connected by said base wall; and a plurality of teeth extending away from the longitudinal axis, wherein said teeth are defined by bittings; and a plurality of section members, wherein each of said section members is disposed within said channel and is movably coupled to said blade, and wherein said section members are longitudinally offset from one another and are transversely movable relative to said blade and relative to one another.

2. The key of claim 1, wherein each of said section members includes a protrusion facing said open face of said channel.

3. The key of claim 2, wherein each of said section members includes a depression facing said open face of said channel.

4. The key of claim 1, further comprising a plurality of support members, wherein each support member extends between and is connected to said first and second side walls, and wherein each of said section members is movably mounted to a corresponding one of said support members.

5. The key of claim 4, wherein each of said section members is translatable along said corresponding one of said support members, and wherein said support members prevent longitudinal movement of said section members.

6. The key of claim 1, wherein each of said section members is mounted to a pair of support members that extend between and are connected to at least one of said first and second side walls.

7. A lock comprising:

a lock cylinder defining a substantially straight keyway, said keyway including a straight path and a tortuous path, wherein said straight path extends along an axial plane defining a longitudinal direction and a transverse direction, and wherein said tortuous path extends alongside said straight path in said longitudinal direction, is offset from said straight path in said transverse direction, and is tortuous in said transverse direction;

a plurality of stationary section members mounted in the keyway;

each of said stationary section members having opposite, facing protrusions that define a gap therebetween; and wherein, together, said gaps in said stationary section members form said tortuous path along said keyway.

8. The lock of claim 7, wherein said protrusions are rounded to facilitate entry of a key.

9. The lock of claim 7, wherein said keyway comprises a height dimension and a width dimension less than said height dimension, and wherein said gaps are offset from one another in a direction of said height dimension such that said tortuous path is non-linear and varies in said direction of said height dimension.

10. The lock of claim 9, wherein said lock cylinder is a pin tumbler lock;

wherein said keyway is sized and configured to receive a key blade including a plurality of movable section members and a plurality of teeth extending in said direction of said height dimension;

wherein said teeth are configured to engage pin tumblers of said pin tumbler lock to move said pin tumblers in said direction of said height dimension; and wherein said protrusions of said stationary section members are configured to move said movable section members in said direction of said height dimension as said key blade is inserted into said keyway.

11. A system comprising:

a key including a bow and a blade attached to and extending away from said bow along a longitudinal axis;

said blade comprising a channel extending along said blade, said channel including an open side along said blade;

a plurality of section members disposed within said channel and coupled to said blade, each of said section members being movable relative to said blade in said channel and including at least one protrusion extending toward said open side of said channel;

a lock comprising a lock cylinder having a keyway comprising multiple stationary section members defining a tortuous path along said keyway; and wherein, when said key is inserted into said keyway, said protrusions of said section members contact said stationary members and move said section members relative to said blade within said channel to pass through said tortuous path.

12. The system of claim 11, wherein said lock is a pin tumbler lock.

13. The system of claim 11, wherein said blade includes teeth extending outwardly from a channel side wall.

14. The system of claim 11, wherein each of said section members includes at least one depression facing said open side of said channel.

15. The system of claim 11, wherein each of said multiple stationary section members includes opposite lock protrusions defining a gap therebetween.

16. The system of claim 15, wherein said gaps together define said tortuous path.

17. The system of claim 11, wherein each of said section member is supported in said channel with at least one support member extending between and connected to opposite side walls defining said channel.

18. The system of claim 17, wherein said at least one support member includes a pair of support members extending through each of said section members.

19. The system of claim 11, wherein said channel extends longitudinally along said blade and is defined by a base wall and a pair of side walls, wherein said base wall is positioned opposite said open side, wherein said side walls extend laterally from said open side to said base wall, wherein said side walls are transversely offset from one another, and wherein said section members are transversely movable relative to said blade.

* * * * *